US005743640A

United States Patent [19]

Crossley

[11] Patent Number: 5,743,640

[45] Date of Patent: Apr. 28, 1998

[54] ICE CREAM TWISTING APPARATUS

[76] Inventor: Jimmy L. Crossley, 3218 Nebraska Ave., Council Bluffs, Iowa 51501

[21] Appl. No.: 597,220

[22] Filed: Feb. 6, 1996

[51] Int. Cl.[6] ..... B01F 15/02; B01F 7/00

[52] U.S. Cl. ..... 366/194; 366/155.1; 366/279

[58] Field of Search ..... 366/77, 97, 98, 366/99, 167.1, 167.2, 172.1, 172.2, 177.1, 178.2, 178.3, 168, 102, 152.1, 194, 144, 155.1, 165.3, 292, 293, 297, 290, 195, 279; 222/197, 216, 222, 226, 228, 236, 239, 263, 253, 271, 273; 62/343, 342

[56] References Cited

U.S. PATENT DOCUMENTS

| | | | |
|---|---|---|---|
| 3,276,633 | 10/1966 | Rahauser | 22/129.1 |
| 3,623,705 | 11/1971 | Townsley | 366/172.1 |
| 3,684,252 | 8/1972 | Nissle et al. | 366/172.1 |
| 3,813,082 | 5/1974 | Manser | 366/84 |
| 3,830,407 | 8/1974 | Wierlo | 222/145.6 |
| 3,831,906 | 8/1974 | Wakeman | 366/172.2 |
| 4,053,144 | 10/1977 | Ellwood | 366/97 |
| 4,194,841 | 3/1980 | Tadmor | 366/293 |
| 4,322,202 | 3/1982 | Martinez | 366/83 |
| 4,416,548 | 11/1983 | Carre et al. | 366/178.1 |
| 4,421,413 | 12/1983 | Sekighuchi | 366/279 |
| 4,580,905 | 4/1986 | Schwitters et al. | 366/290 |
| 4,957,626 | 9/1990 | Ashbrook et al. | 366/336 |
| 5,450,786 | 9/1995 | Muntener | 366/155.1 |

*Primary Examiner*—Tony G. Soohoo
*Attorney, Agent, or Firm*—Zarley, McKee, Thomte Voorhees & Sease; Mark D. Frederiksen

[57] ABSTRACT

An ice cream twisting apparatus includes an elongated housing with a mixing chamber formed within the interior thereof. An inlet port extends through the top of the housing to the mixing chamber to provide soft serve ice cream to the mixing chamber. A blending rod is mounted for rotation in the mixing chamber and includes a central disk which divides injected ice cream into two separate mixing chambers. A passageway through the housing to each of the individual mixing chambers permits the introduction of a desired flavor into the ice cream. The blending rod then mixes the individual flavor with the ice cream and the separate mixing chamber. Outlet tubes extend from the individual mixing chambers to an outlet port to provide two separate flavors of ice cream at the outlet port.

5 Claims, 4 Drawing Sheets

ICE CREAM TWISTING APPARATUS

TECHNICAL FIELD

The present invention relates generally to soft serve ice cream machines, and more particularly to an improved apparatus for twisting two flavors of ice cream together into a single output.

BACKGROUND OF THE INVENTION

Soft serve ice cream has been a popular food product for many years. Flavored soft serve ice cream is conventionally formed by adding a desired flavoring to a liquid ice cream mixture and then freezing the mixture to produce a flavored product.

It is now popular to combine two flavored soft serve products into a single "twist", wherein the two distinct flavors are twisted together into a cone or cup, without blending the flavors together, thereby producing a striped look in the end product.

While the "twist" of two individual flavors of soft serve ice cream has been popular, the possible combination of flavors has been limited. Conventional mechanisms for producing a twisted end product of two flavors utilize two independent sources of soft serve ice cream, each source having the desired flavor already blended therein. Thus, a vanilla soft serve product may be twisted with a chocolate soft serve product, the vanilla and chocolate products being drawn from separate containers and twisted together at a dispensing outlet. While the conventional twist mechanism works satisfactorily for their intended purpose, the consumer is restricted to the two particular prepared soft serve flavors which are present at the twist machine. Thus, a twist machine has a first dispenser for vanilla soft serve, a second dispenser for chocolate soft serve, and a third dispenser interposed between the first and second dispensers to form a twist product. The only way in which flavors may be changed in the conventional twist machine is by replacing the entire soft serve dispenser with the desired flavor.

SUMMARY OF THE INVENTION

It is therefore a general object of the present invention to provide an improved ice cream twisting apparatus for twisting a plurality of flavored soft serve ice creams into a single twisted output.

Another object is to provide an improved ice cream twisting apparatus which can produce a twisted output of a plurality of flavors from a single soft serve ice cream source.

Yet another object of the present invention is to provide an ice cream twisting apparatus which is simple to operate and economical to manufacture.

These and other objects of the present invention will be apparent to those skilled in the art.

The ice cream twisting apparatus of the present invention includes an elongated housing with a mixing chamber formed within the interior thereof. An inlet port extends through the top of the housing to the mixing chamber to provide soft serve ice cream to the mixing chamber. A blending rod is mounted for rotation in the mixing chamber and includes a central disk which divides injected ice cream into two separate mixing chambers. A passageway through the housing to each of the individual mixing chambers permits the introduction of a desired flavor into the ice cream. The blending rod then mixes the individual flavor with the ice cream and the separate mixing chamber. Outlet tubes extend from the individual mixing chambers to an outlet port to provide two separate flavors of ice cream at the outlet port.

DESCRIPTION OF THE PREFERRED EMBODIMENT

Figure 1:
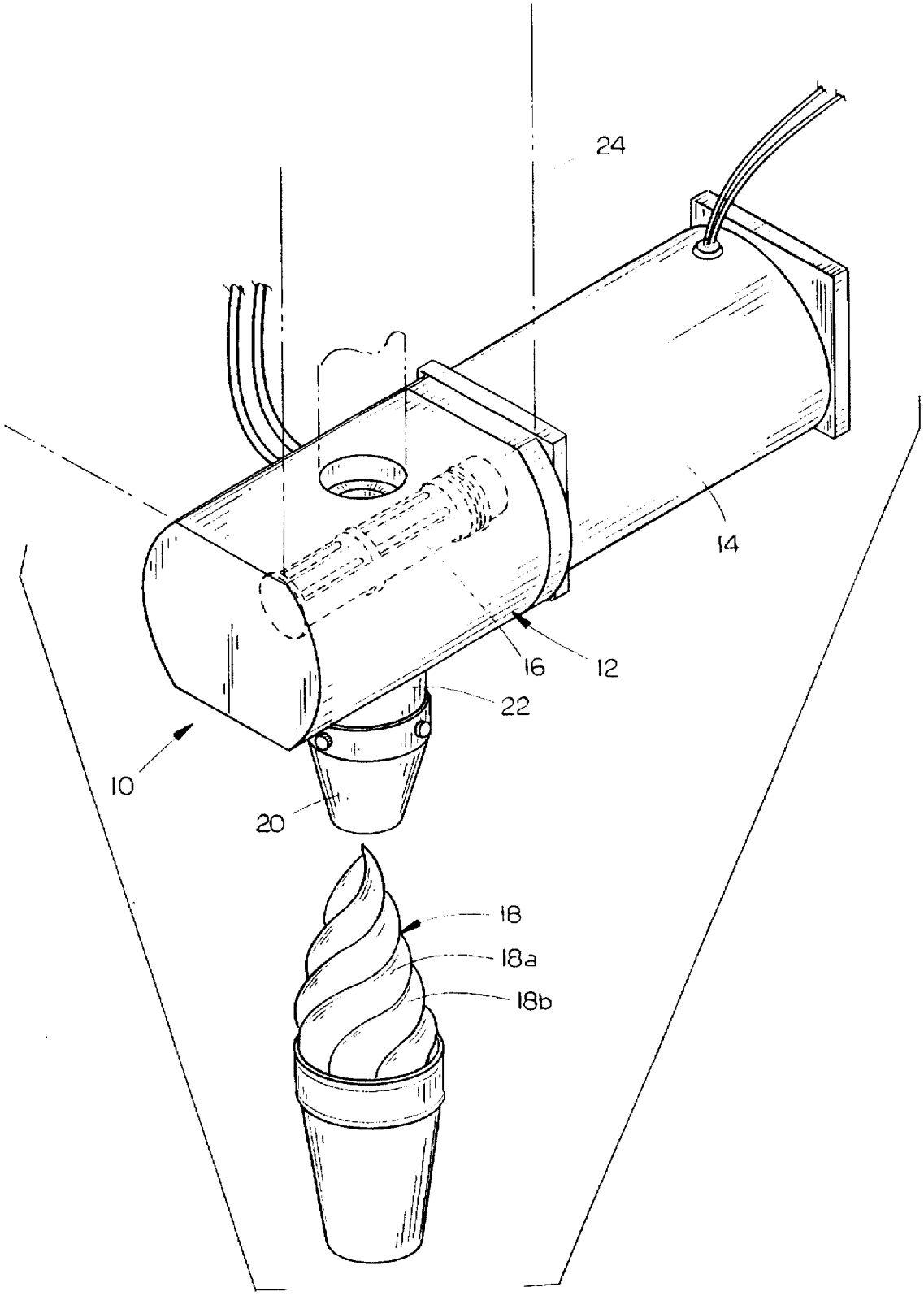
FIG. 1 is a perspective view of the twisting apparatus of the present invention with a twisted ice cream product dispensed in a cup.

Referring now to the drawings, in which similar or corresponding parts are identified with the same reference numeral, and more particularly to FIG. 1, the twisting apparatus of the present invention is designated generally at 10 and includes a housing 12 attached to a drive motor 14 which operates a blending rod 16 (shown in hidden lines) to produce a twisted soft serve ice cream product 18 having two individual flavored ice creams 18*a* and 18*b* twisted together to form a single output. A dispenser nozzle 20 is provided on a depending outlet tube 22 to form the twisted end product 18. A conventional soft serve ice cream unit is designated generally at 24 and shown in hidden lines in FIG. 1.

Figure 2:
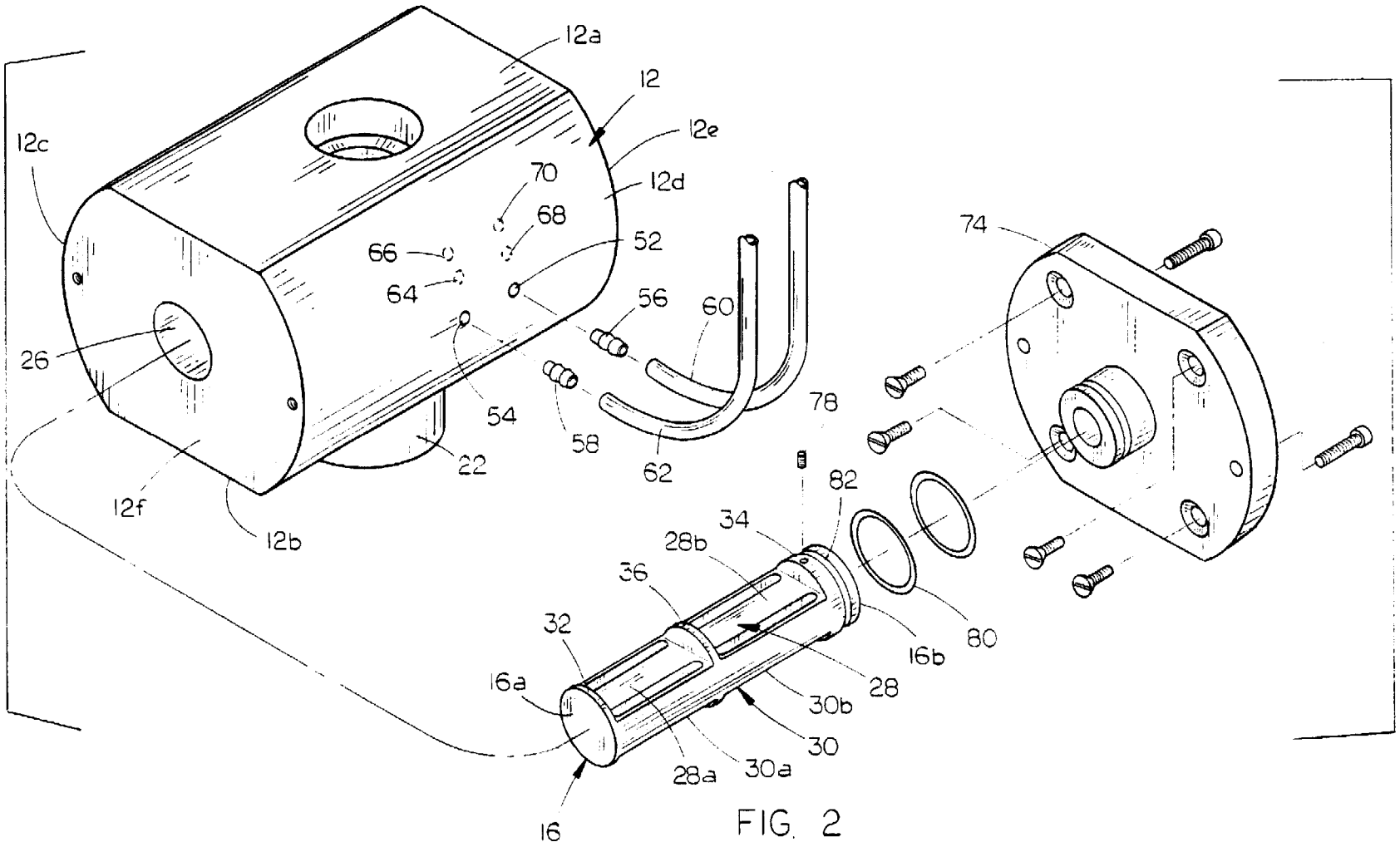
FIG. 2 is an exploded perspective view of the twisting apparatus of the present invention.
Figure 3:
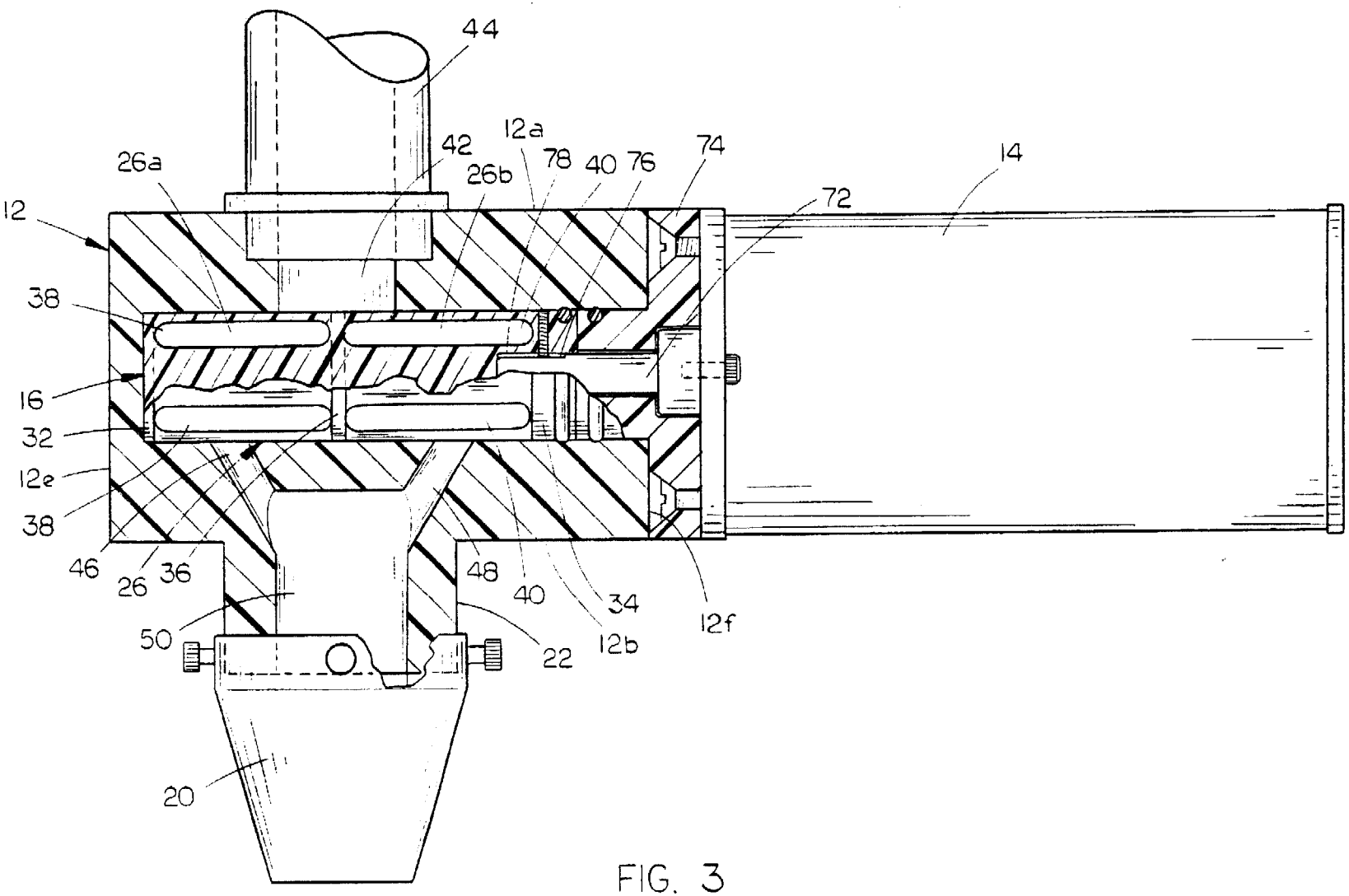
FIG. 3 is a vertical sectional view taken through the longitudinal axis of the twisting apparatus.

Referring now to FIG. 2, housing 12 is an elongated member having a top 12*a*, a bottom 12*b*, opposing longitudinal side walls 12*c* and 12*d*, and forward and rearward ends 12*e* and 12*f*. A cylindrical mixing chamber 26 extends forwardly from rearward end 12*f*, and is preferably formed along the longitudinal axis of housing 12. As shown in FIG. 3, mixing chamber 26 does not extend completely through housing 12, and ends at a forward wall.

Referring once again to FIG. 2, blending rod 16 is a cylindrical member having forward and rearward ends 16*a* and 16*b* respectively, and a diameter slightly less than the diameter of mixing chamber 26, to permit insertion of rod 16 into mixing chamber 26. Blending rod 16 is longitudinally truncated on diametric sides to form parallel flattened portions 28 and 30. The truncations in rod 16 extend less than the full length of rod 16 so as to form a forward disk 32 and rearward disk 34 at the forward and rearward ends of flattened portions 28 and 30. In addition, flattened portions 28 and 30 are preferably centrally divided by a central cylindrical disk 36 to form forward flattened portions or "paddles" 28*a* and 30*a* and rearward flattened portions or "paddles" 28*b* and 30*b*, respectively.

Referring to FIG. 3, it can be seen that central disk 36 separates mixing chamber 26 into two separate forward and rearward mixing chambers 26*a* and 26*b* respectively. Forward mixing chamber 26*a* is formed between forward disk 32 and central disk 36 while rearward mixing chamber 26*b* is formed between central disk 36 and rearward disk 34.

Figure 4:
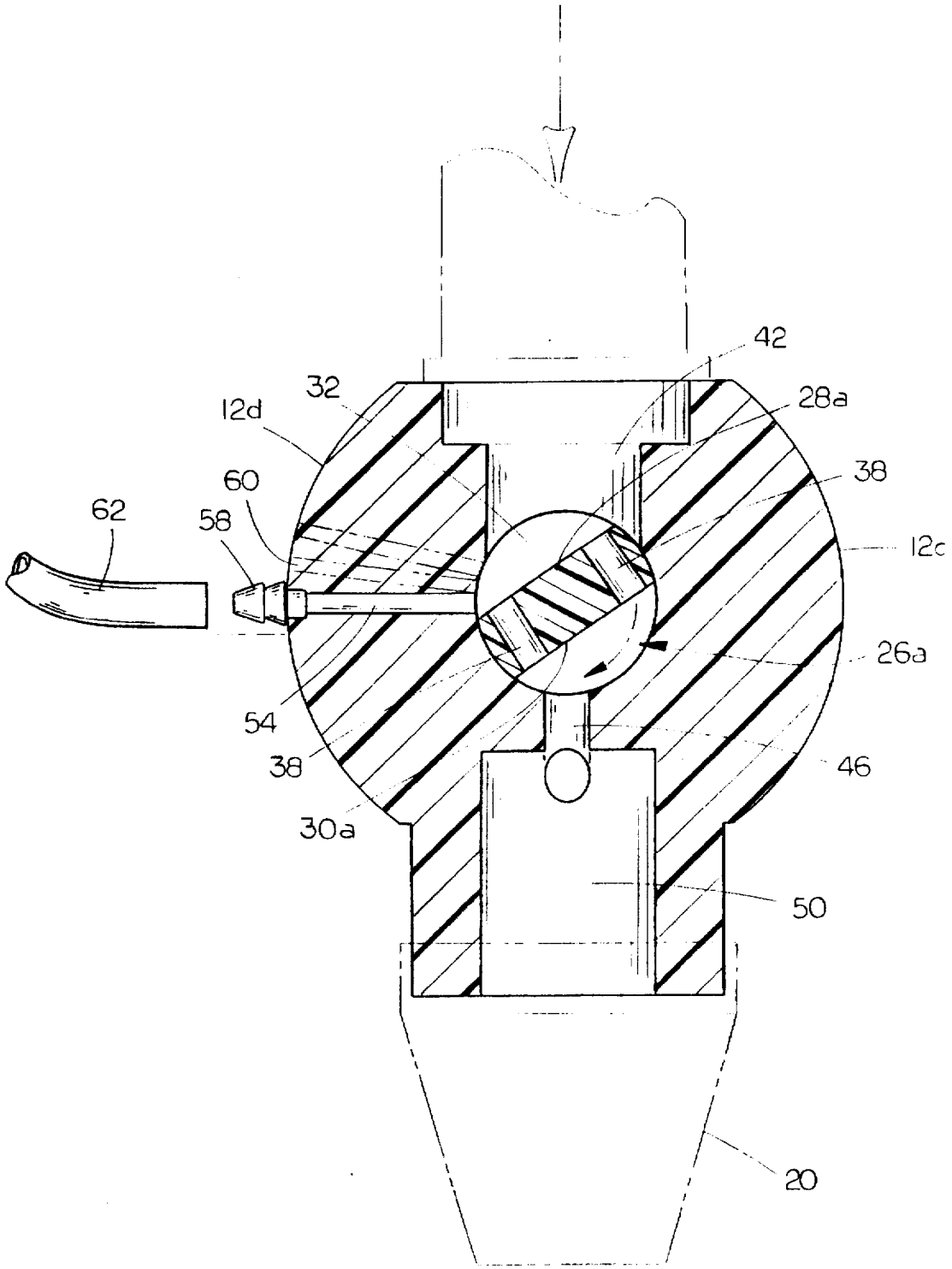
FIG. 4 is a vertical sectional view taken along a central transverse axis of the twisting apparatus.

A pair of spaced apart parallel longitudinal oriented slots 38 are formed through forward paddles 28*a* and 30*a*, and a second pair of slots 40, longitudinally aligned with slots 38, are formed through rearward panels 28*b* and 30*b*. As shown in FIG. 4, slots 38 assist in blending product located in forward mixing chamber 26*a*, by permitting product to flow between panels 28*a* and 30*a*. Similarly, slots 40 permit product to flow between panels 28b and 30b in the rearward mixing chamber 26b (shown in FIG. 3).

A vertical aperture 42 extends downwardly from housing top 12a to communicate with mixing chamber 26, and is centered over central disk 36, as shown in FIG. 3. Aperture 42 forms an input port for soft serve ice cream provided by pipe 44. Because port 42 is centered over central disk 36, one-half of product delivered to mixing chamber 26 will flow into forward mixing chamber 26a, while the other half will flow into rearward mixing chamber 26b.

A pair of outlet tubes 46 and 48 extend from mixing chambers 26a and 26b respectively and communicate with an outlet port 50 located diametric to inlet port 42. Outlet port 50 extends through outlet conduit 22 to dispense product into dispenser nozzle 20.

Referring once again to FIG. 2, a pair of apertures 52 and 54 extend inwardly from side wall 12d to mixing chambers 26a and 26b, respectively. A valve 56 and 58 have an outlet end mounted in the outward end of openings 52 and 54 respectively, with endlet ends connected to tubes 60 and 62 respectively. Tubes 60 and 62 extend to a source of liquid flavoring (not shown). Valves 56 and 58 are operable to prevent back flow of product from the mixing chamber into tubes 60 and 62, and also to prevent the flow of flavoring from tubes 60 and 62 until a predetermined pressure is applied through the tubes. As shown in FIG. 4, aperture 54 will provide a flavoring from tube 62 to mixing chamber 26b (shown in FIG. 3) which is blended with ice cream injected through inlet port 42 and then ejected through outlet tube 46 to outlet port 50. FIGS. 2 and 4 show additional passageways 64, 66, 68 and 70 in broken lines, which may be formed through housing 12 to mixing chambers 26a and 26b to permit the attachment of other individual tubes for independent flavors. Similar passageways may be formed in the opposite side wall 12c, as well. In this way, any one of a number of flavors may be blended with ice cream in either of individual mixing chambers 26a and 26b.

Referring again to FIG. 3, drive motor 14 has a drive shaft 72 projecting from the forward end thereof, extending through a mounting plate 74 and received within an opening 76 in the rearward end of blending rod 16. Drive shaft 72 is locked in position with blending rod 16 by a set screw 78, in a conventional fashion, such that drive shaft 72 will rotate rod 16 within housing 12.

An "O" ring 80 is mounted in an annular groove 82 on the exterior of rearward disk 34, as shown in FIG. 2, to provide a seal between blender rod 16 and mixing chamber 26. Mounting plate 74 secures drive motor 14 to the rearward end of housing 12.

Whereas the invention has been shown and described in connection with the preferred embodiment thereof, many modifications, substitutions and additions may be made which are within the intended broad scope of the appended claims.

I claim:

1. A twisting apparatus, comprising:

an elongated housing having an exterior surface, a top and bottom, opposing longitudinal sides, and first and second ends;

a mixing chamber within said housing;

an inlet port extending through the housing top and communicating with the mixing chamber for inputting product into said mixing chamber;

at least one wall dividing the mixing chamber into a plurality of separate mixing chambers, each of which communicates with the inlet port to receive product therefrom;

a passageway extending from a first of said plurality of separate mixing chambers to the exterior surface of the housing for selectively injecting flowable product into the first separate mixing chamber;

means in each of said separate mixing chambers for mixing product within each of said separate mixing chambers;

an outlet port formed in the bottom of the housing for dispensing mixed product from the mixing chambers; and outlet tubes extending from each separate mixing chamber to said outlet port for dispensing mixed product from each of said separate mixing chambers to the outlet port.

2. The twisting apparatus of claim 1, further comprising a second passageway, independent of the first passageway, extending from a second of said plurality of separate mixing chambers to the exterior surface of the housing for selectively injecting flowable product into the second separate mixing chamber.

3. The twisting apparatus of claim 2, further comprising a third passageway independent of the first passageway extending from the first separate mixing chamber to the exterior surface of the housing for selectively injecting a second flowable product into the first separate mixing chamber.

4. The twisting apparatus of claim 1, further comprising a valve in said first passageway, for preventing flow of flowable product from the mixing chamber to the housing exterior and permitting flow of flowable product through the first passageway from the housing exterior to the mixing chamber.

5. The twisting apparatus of claim 1, wherein said means for mixing product within said chambers includes a single blender rod extending through all of said chambers and connected to a drive motor, for simultaneously mixing product in all of said chambers.

* * * * *